United States Patent [19]

Schleicher

[11] 3,979,011

[45] Sept. 7, 1976

[54] AUXILIARY HANDLE FOR A BEVERAGE CAN

[76] Inventor: Roger W. Schleicher, 139 Croyden Lane, DeWitt, N.Y. 13224

[22] Filed: Dec. 23, 1974

[21] Appl. No.: 535,273

[52] U.S. Cl. ..... 220/94 R; 220/8; 220/69; 220/90.6; 220/85 H; 220/287

[51] Int. Cl.[2] ..... A47G 19/22; B65D 25/28

[58] Field of Search ..... 220/94 R, 69, 90.2, 220/90.4, 90.6, 8, 306, 287, 85 H; 222/83.5, 88

[56] References Cited

UNITED STATES PATENTS

| | | | |
|---|---|---|---|
| 1,837,784 | 12/1931 | Luckett | 220/8 |
| 1,891,077 | 12/1932 | Beach | 220/69 |
| 2,039,643 | 5/1936 | Gailor | 222/83.5 |
| 2,559,362 | 7/1951 | Langfeld | 220/90.2 |
| 2,581,768 | 1/1952 | O'Casey | 220/90.2 |
| 2,838,202 | 6/1958 | Huether | 220/94 R |
| 3,346,139 | 10/1967 | Armstrong, Jr. | 220/320 |
| 3,352,448 | 11/1967 | Livingstone | 220/306 |
| 3,429,478 | 2/1969 | Ward | 220/90.2 |

FOREIGN PATENTS OR APPLICATIONS

| | | | |
|---|---|---|---|
| 468,711 | 7/1937 | United Kingdom | 220/85 K |

*Primary Examiner*—George E. Lowrance
*Assistant Examiner*—Allan N. Shoap
*Attorney, Agent, or Firm*—Bruns & Jenney

[57] ABSTRACT

An auxiliary handle for use in drinking a beverage directly from its original can. The handle coacts with the beverage can to convert it into a hand held mug and thus makes it unnecessary to hold the can directly which causes chilled beverages to be warmed. The handle includes annular members that engage the upper and lower ends of the can and the upper member is constructed in such a manner that the user's mouth does not touch the can when drinking. The handle also includes an adjustment which enables it to be used with either 12 oz. or 16 oz. standard beverage cans.

2 Claims, 8 Drawing Figures

FIG. 3
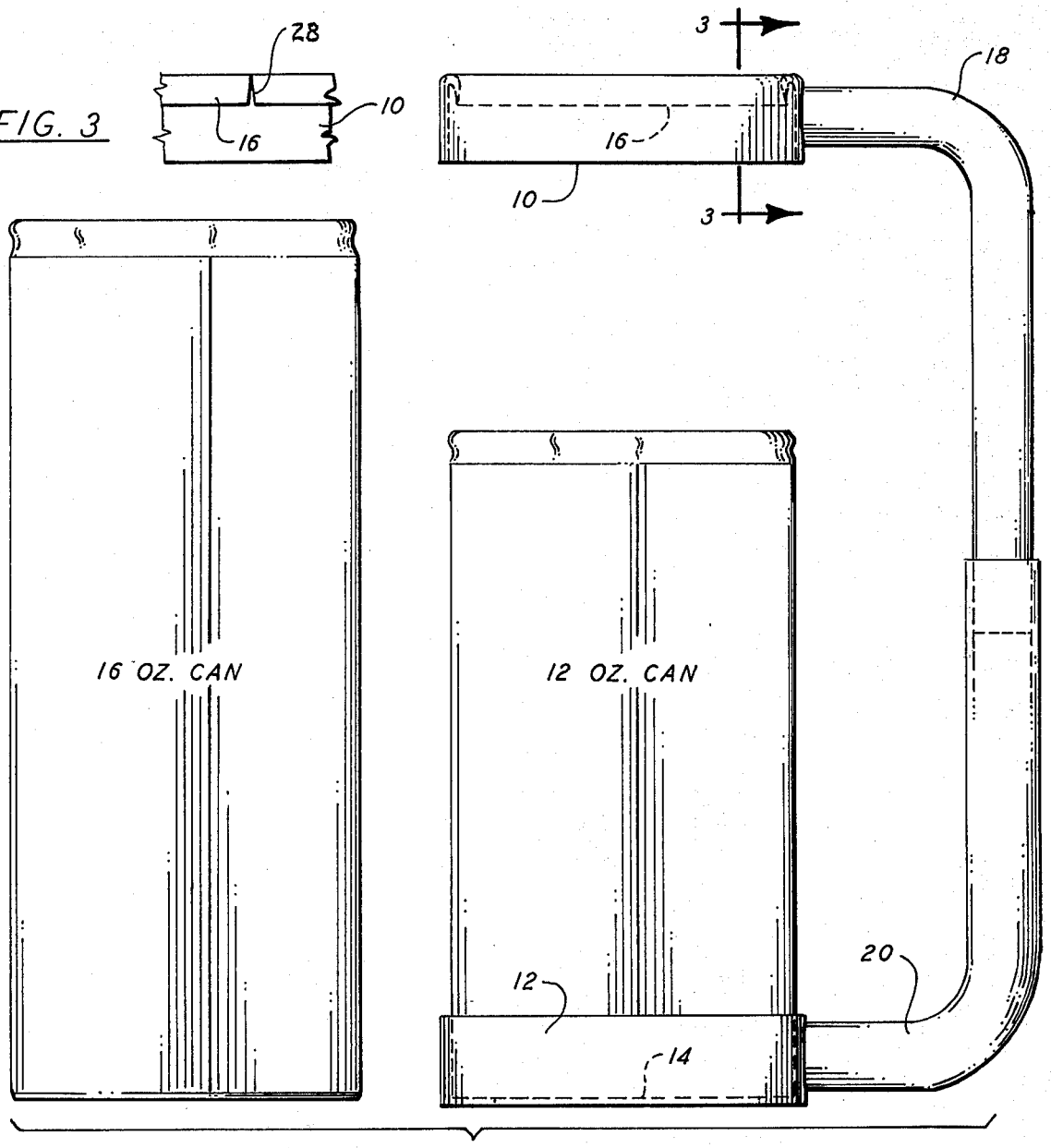
FIG. 2
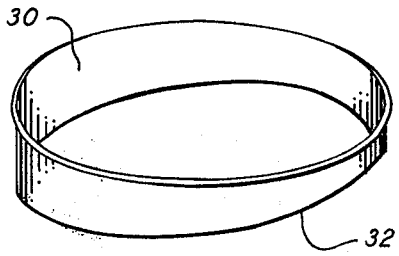
FIG. 7
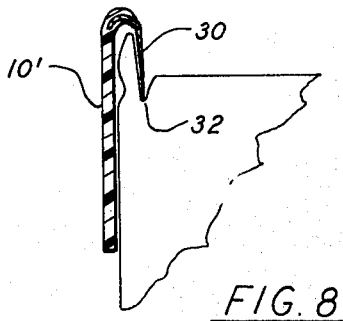
FIG. 8

AUXILIARY HANDLE FOR A BEVERAGE CAN

BACKGROUND OF THE INVENTION

This invention relates generally to beverage containers, and has particular reference to a novel auxiliary handle for use in drinking a beverage directly from its original can.

The practice of drinking beer and soft drinks directly from the cans in which they are purchased is widespread, particularly among young adults. This practice may have some undesirable aspects such as an unwanted heat exchange between the can and the hand that holds it and the possibility that the can may not be perfectly clean where it is contacted by the user's mouth. A number of detachable beverage can handles have been proposed in the past with the objective of eliminating one or more of the undesirable aspects noted above. The majority of these have been awkward to use or otherwise impractical, and they have not been widely accepted.

The closest prior art known to the applicant is disclosed in U.S. Pat. Nos. 2,580,824; 2,838,202; 3,029,975 and 3,261,635. Of these, U.S. Pat. No. 2,838,202 to C. P. Huether is the closest to the present invention in that it eliminates the necessity for holding the beverage can with the hands, and the user's mouth contacts the can handle or holder rather than the can itself when drinking. The invention disclosed herein differs from the handle of the Huether patent inter alia in the manner in which it provides for sanitary drinking and in its substantially more compact design overall.

SUMMARY OF THE INVENTION

The beverage can handle of the invention is a two piece assembly comprising upper and lower annular members adapted to engage the upper and lower ends of the can. Connected to each annular member is a tubular handle element and these elements interengage in an adjustable manner to permit engagement of the annular members with the ends of either a 12 oz. or 16 oz. standard beverage can. The upper annular member is provided at its upper edge with an inwardly and downwardly extending lip that is adapted to overlie and completely encompass the upper edge of the beverage can whereby the mouth of the user will not normally come into contact with the can.

In one form of the invention, the upper annular member of the can handle is provided at its upper edge with an annular metal cutting member that operates to cut out the entire top of the can when pressed into engagement therewith. This cutting member is molded into the annular member which is preferably formed of plastic.

BRIEF DESCRIPTION OF THE DRAWINGS

FIG. 2 is a side elevation of the can handle in an extended position to illustrate how the handle can accommodate a 16 oz. as well as a 12 oz. beverage can;

FIG. 3 is a fragmentary vertical section taken on line 3—3 of FIG. 2;

FIG. 7 is a perspective view of the metal cutting member; and

FIG. 8 is a view corresponding to FIG. 4 showing the cutting member substituted for the lip on the upper annular member.

DESCRIPTION OF THE PREFERRED EMBODIMENTS

Figure 1:
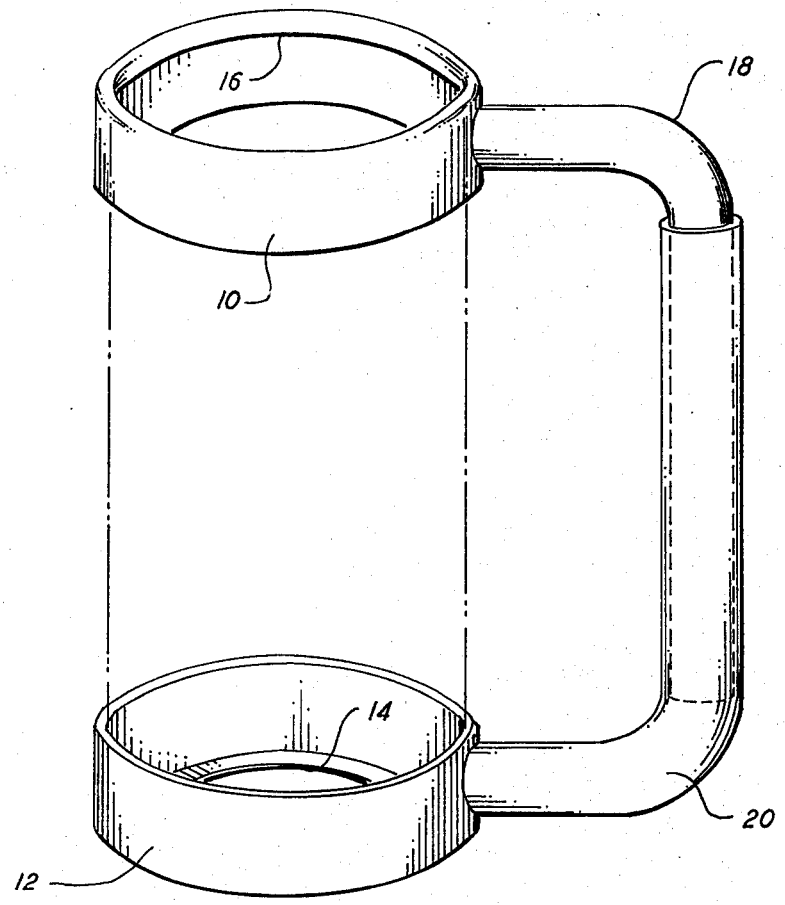
FIG. 1 is a perspective view of a beverage can handle embodying the invention.

Having reference now to the drawings, the auxiliary handle includes upper and lower annular members 10 and 12 adapted to engage the upper and lower ends of a beverage can. Members 10 and 12 are in the form of vertically walled rings and the inner diameters of these rings are such that they encircle the can ends with a free but close fit. At the present time, practically all beverage cans are cylindrical and there is no more than ⅛ inch difference in the outside diameters of the aluminum and steel cans, the two principal types.

The lower annular member 12 is provided at its lower edge with an inwardly extending horizontal flange 14 adapted to engage the lower end of the can, or on which the can rests. Upper annular member 10 is provided at its upper edge with an inwardly and downwardly extending lip 16 which is adapted to overlie the upper edge of the can. This lip will be described in more detail hereinafter.

Secured to the upper annular member 10 is a tubular handle element 18 that extends outwardly from the member and then has a substantially 90° downward bend as shown. The vertical portion of handle element 18 is telescopically received in a similar handle element 20 that extends outwardly and upwardly from the lower annular member 12. There is sufficient overlap in the telescoping portions of elements 18 and 20 so that the can handle can be extended enough to accept a 16 oz. standard beverage can as indicated in FIG. 2.

To use the can handle, its handle elements 18 and 20 are simply extended sufficiently to accept a 12 or 16 oz. standard beverage can, the bottom of the can is placed in the lower annular member 12 as shown in FIG. 2 and the upper member 10 is pressed down into snug engagement with the top of the can. The can may be opened either before or after the handle is placed thereon by removing the usual pull tab in the can top or by any other suitable means.

Figure 5:
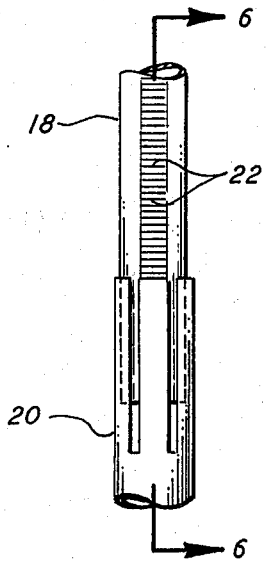
FIG. 5 is a fragmentary side elevation of the telescoping portion of the can handle showing the details of the releasable holding means.
Figure 6:
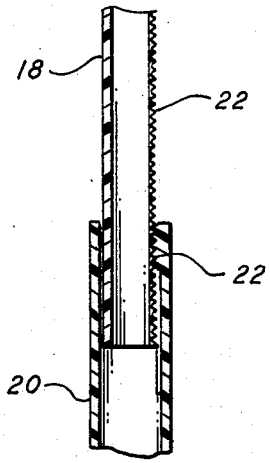
FIG. 6 is a vertical section taken on line 6—6 of FIG. 5.

In order to insure that the upper and lower annular members will remain in engagement with the can during consumption of the beverage, the telescoping portions of the handle elements 18,20 are provided with mating serrations or teeth 22 best shown in FIGS. 5 and 6. These prevent inadvertent separation of the handle elements. To disengage the mating serrations, the handle elements 18 and 20 are rotated relative to one another until their respective serrations are no longer in registry. This makes it easy to slide element 18 into or out of element 20 to the approximate position desired after which the elements can again be rotated to reengage the serrations.

Figure 4:
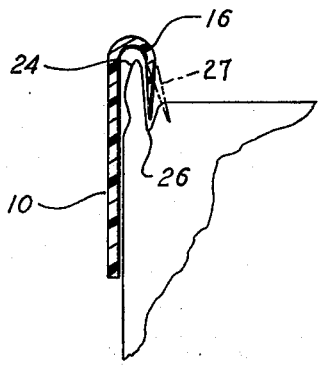
FIG. 4 is a fragmentary, diagrammatic illustration, partly in section, showing how the lip of the can handle upper annular member overlies the upper edge of the can.

It is contemplated that annular members 10,12 and handle elements 18,20 will be molded using a material having some flexibility such as a polyvinyl chloride type plastic. As best shown in FIG. 4, the lip 16 on the upper annular member 10 is proportioned so that it overlies the upper edge 24 of the beverage can and extends substantially to the bottom of a circular groove or recess 26 that is present in nearly all beverage cans that are manufactured at the present time, the groove being below and just inside the upper edge of the can as shown. With this construction, the mouth of the user will not normally come into contact with the can while drinking the beverage.

As may be seen in FIG. 4, the lip 16 tapers to a feather edge at its lower extremity in order to increase its flexibility. As noted above, there are two principal types of beverage cans in use today and in one the diameter of its groove 26 at the bottom is ⅛ inch larger than the diameter of the groove of the other at the bottom. The flexibility of the lip 16 enables it to extend down into the groove of either type can, the alternative position of the lip being indicated by phantom lines at 27 in FIG. 4. Since the different possible groove diameters necessitate some slight expansion and contraction of the lower, feather edge of lip 16, the lip may be cut as indicated at 28 in FIG. 3 at diametrically opposite points on the annular member 10 to aid this action.

In a modified form of the invention, an annular metal cutting member 30, FIGS. 7 and 8, is substituted for the flexible lip 16 on the upper annular member 10. The cutting member, which is preferably of steel, is molded into the plastic member 10' as shown in FIG. 8 and has a sharpened cutting edge 32 at its lower extremity. With this arrangement, when the upper annular member is pushed down into engagement with the top of the can, the cutting member 30 cuts through the top just inside the upper edge 24 thereby enabling the entire top to be removed. Prior to pushing down on the annular member to effect the cut, the pull tab is grasped and held with the fingers to prevent the top from sinking to the bottom of the can.

As best shown in FIG. 7, the cutting edge 32 of cutting member 30 is obliquely disposed with respect to its upper edge which makes the cutting action progressive and thus somewhat easier. As the cutting edge moves downwardly to make the cut it also turns down any part of the top that remains so that there are no rough edges. Like the flexible lip 16, the cutting member 30 together with the upper annular member 10' overlies and completely encompasses the upper edge 24 of the beverage can so that the mouth of the user will not normally come into contact with the can while drinking.

In the auxiliary can handle just described, the portion 18,20 that is held by the user is spaced far enough from the can so that there is no transfer of heat from the hand to a chilled drink in summer, or transfer of cold from a chilled drink to the hand in winter. Also, as noted, with either modification of the can handle reasonable sanitary precautions are taken by shielding the user from the can while drinking the beverage. Obviously, the can holder must be washed after use but this is generally easier than washing glasses and removes the possibility of glass breakage.

The can handle of the invention is compact and adds relatively little weight to the can. Because of its simple construction, it can be economically produced and yet it is very durable. The straight sided upper and lower annular members 10 and 12 lend themselves, if desired, to carrying identifying indicia of the beverage maker or personal identification of the owner.

From the foregoing description, it will be apparent that the invention disclosed herein provides a novel and advantageous auxiliary handle for a beverage can. As will be understood by those familiar with the art, the invention may be embodied in other specific forms without departing from the spirit or essential characteristics thereof.

I claim:

1. An auxiliary handle for a beverage can formed with an annular groove just inside its upper edge, the handle comprising upper and lower annular members adapted to engage the upper and lower ends of the can, and tubular elements extending outwardly from the annular members and telescopically engageable with one another to form the portion of the handle that is grasped by the user, the lower annular member having the form of a vertically walled ring that extends upwardly to form a band around the lower end of the can, the lower annular member having an inwardly extending horizontal flange at its lower edge for engagement with the bottom of the can, and the upper annular member having the form of a vertically walled ring that extends downwardly to form a band around the upper end of the can, the upper annular member having a flexible, integral lip at its upper edge that extends inwardly to overlie the upper edge of the can and then downwardly to extend into the annular groove that is inside thereof, the flexibility of the lip permitting it to extend into the annular grooves of standard beverage cans of different diameters.

2. A beverage can as defined in claim 1 wherein the lip on the upper annular member tapers to a feather edge at its outer extremity.

* * * * *